United States Patent [19]

Peters

[11] Patent Number: 4,925,240

[45] Date of Patent: May 15, 1990

[54] PERSONAL COMPUTER DESK

[76] Inventor: William T. Peters, 129 Wilson Ave., No. 6, Galax, Va. 24333

[21] Appl. No.: 342,139

[22] Filed: Apr. 24, 1989

[51] Int. Cl.[5] ..... A47C 7/62

[52] U.S. Cl. ..... 297/161; 297/217; 248/917

[58] Field of Search ..... 297/160, 161, 162, 217; 298/917, 918

[56] References Cited

U.S. PATENT DOCUMENTS

| | | | |
|---|---|---|---|
| 1,295,043 | 2/1919 | Lattig | 297/160 X |
| 1,416,518 | 5/1922 | Smiley | 297/160 |
| 1,452,343 | 4/1923 | Jones | 297/161 |
| 1,888,263 | 11/1932 | Geiger | 297/161 |
| 3,762,767 | 10/1973 | Powell | 297/217 |
| 4,584,603 | 4/1986 | Harrison | 297/217 X |
| 4,735,466 | 4/1988 | Volters et al. | 248/918 X |
| 4,852,500 | 8/1989 | Ryburg et al. | 248/918 X |

*Primary Examiner*—Peter A. Aschenbrenner
*Attorney, Agent, or Firm*—Diller, Ramik & Wight

[57] ABSTRACT

A personal computer desk which has a recess in the desk top of a depth, size and configuration to accommodate a range of personal computer keyboards, and a portion of the desk top also forms a lid to cover the personal computer when closed, but once unlocked and in its open position, a face of the lid carries a liquid crystal screen for displaying images thereon thereby adapting the desk for universal usage. An area below the seat of the desk is totally permanently closed on all but one side and this one side can be closed through the use of a roll-top shutter door for storage purposes. A rear end portion of the desk top is mounted for up and down and fore and aft adjustment relative to the desk frame and in conjunction with the latter a front end portion of the desk top is also mounted for selective step-wise vertical adjustment.

30 Claims, 2 Drawing Sheets

10
11
12
13
14
15
16
17
20
21
22
23
24
25
26
27
30
31
32
33
34
35
36
37
38
40
41
42
43
45
50
51
52
53
60
61
62
80
81
82
83
84
90
107
123
127
133
K
PC

PERSONAL COMPUTER DESK

BACKGROUND OF THE INVENTION

The field of art to which the invention pertains is desks and specifically a novel and unobvious desk for a personal computer.

Many school systems throughout the United States now require at least one course in computer literacy. In addition, many U.S. high schools and colleges offer classes in computer programming and classes designed to teach students how to use the computer as a tool from problem solving. The personal computer (PC) has made computing power available to students at university, college, high school, intermediate and even elementary school levels. The personal computer and its involvement in education has virtually revolutionized classroom teaching and it is predicted that within a few years twenty (20) million computers will be in use. However, in order for computers to be used individuals must be taught the intricacies of computers; yet in today's world of high technology there is yet to be provided an innovative, simple, versatile and efficient desk for a personal computer which can be utilized primarily in the classroom, though is equally suited at home or in business.

Presently conventional so-called computer "stations" are excessively large, as are the larger computers associated therewith. Such large work stations are wholly inadequate for schoolroom purposes because schools simply have limited space available. Furthermore, any available space which is utilized for present day computer studies is so specialized that the space is not otherwise utilized. Obviously, if the same space can be used alternately for computer and noncomputer educational purposes, space utilization would be maximized as would be student education.

SUMMARY OF THE INVENTION

In keeping with the foregoing, the present invention solves the problems immediately noted heretofore by providing a novel personal computer desk which is mobile, streamlined, lightweight, durable, comfortable and meets the ever changing criteria of school systems for universal furniture which can be utilized for virtually any curriculum, even though specifically designed for computer education. The personal computer desk evolved from a "conventional" school desk which includes the usual legs seat, back rest and desk top. However, pursuant to the present invention, the personal computer desk includes:

(1) a recess in the desk top of a depth, size and configuration to accommodate a range of personal computer keyboards, and a portion of the desk top also forms a lid to cover the personal computer when closed (and locked if desired), but once unlocked and in its open position, a face of the lid carries a liquid crystal screen for displaying images thereon thereby adapting the desk for universal usage;

(2) an area below the seat of the desk is totally permanently enclosed on all but one side and this one side can be closed (and locked) through the use of a roll-top shutter door to allow personal items to be stored when not in use;

(3) a rear end portion of the desk top is mounted for up and down and fore and aft adjustment relative to the desk frame., and (4) in conjunction with the latter a front end portion of the desk top is also mounted for selective step-wise vertical adjustment.

Collectively features (1) through (4) offer a specialized personal computer desk of high sophistication and efficiency, yet the desk through but the mere closing of the lid can be transformed into a universal school desk capable of being utilized for virtually any educational purposes.

With the above and other objects in view that will hereinafter appear, the nature of the invention will be more clearly understood by reference to the following detailed description, the appended claims and the several views illustrated in the accompanying drawings.

DESCRIPTION OF THE PREFERRED EMBODIMENT

Figures 1, 2:
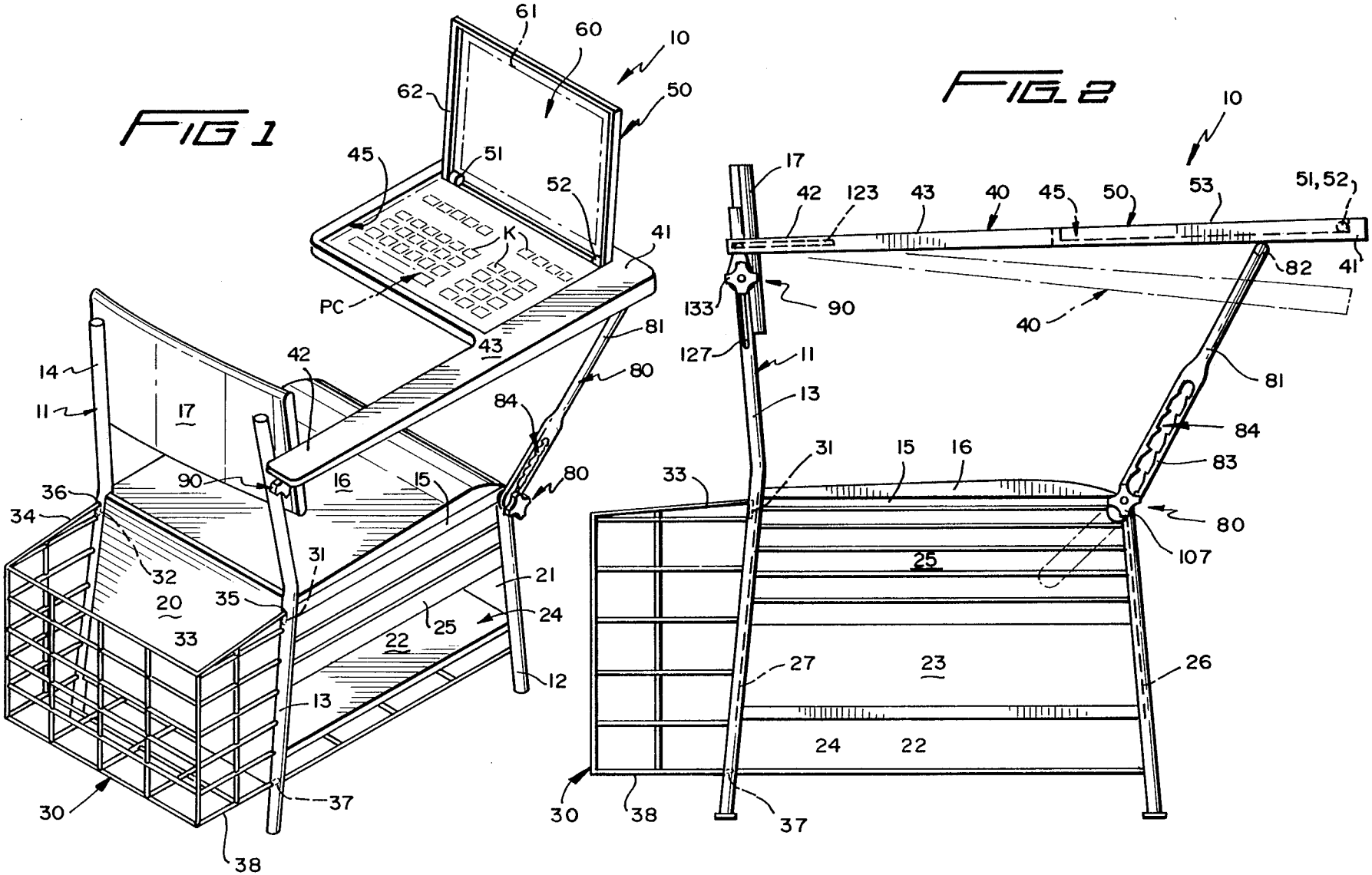
FIG. 1 is a top perspective view of a novel personal computer desk of the present invention, and illustrates a desk top having a recess housing a personal computer and a portion of the desk top pivoted to its open position for displaying images upon a liquid crystal screen thereof.
FIG. 2 is a side elevational view of the personal computer desk of FIG. 1, and illustrates a roll-top shutter door partially closing a storage area beneath the seat of the desk and front and rear desk top adjusting mechanisms.

A novel personal computer desk constructed in accordance with this invention is fully illustrated in FIGS. 1 and 2 of the drawings and is generally designated by the reference numeral 10. The personal computer desk 10 includes a frame generally designated by the reference numeral ii which includes a plurality of convention tubular members 12 through 15 (and others not illustrated); a seat 16; a back rest 17 connected conventionally between the upper ends of the tubular members 13, 14; a rear wall 20; a front wall 21; a bottom wall 22; and a side wall 23 collectively defining a storage chamber 24 accessible from but only one side when a roll-top shutter door 25, shown partially open, is fully open. The roll-top shutter door 25 has opposite edges (unnumbered) which run in tracks or grooves 26, 27 (FIG. 2) formed in or carried by the respective tubular members 12, The tracks or grooves 12, 13 continue along the underside of the seat 15 toward the side 23 so that in the fully opened position of the opening 24 the roll-top shutter door 25 is housed entirely within the storage chamber 24 and immediately adjacent the underside of the seat 16. However, the roll-top shutter door 25 can be fully closed and, if desired, provided with an appropriate lock for securing to the bottom wall 22.

A storage basket 30 for books or the like is formed of relatively lightweight though heavy gauged wire and is removably secured to the tubular elements 3, 14 by means of downwardly bent ends 31, 32 of two of the uppermost basket wires 33, 34, respectively being hooked into openings 35, 36 of the respective tubular members 13, 14. The lowermost wires 38 (only one being numbered in FIG. 1) have ends 37 which are received in openings (unnumbered) in each of the tubular members 13, 14. The wire storage basket 30 is sized to fit within the storage chamber 24. Thus, the wire storage basket 30 can be quickly removed from and replaced upon the frame 11 in a manner apparent from the foregoing description. Obviously, if articles and the wire storage basket 30 are both to be housed within the storage chamber 24, the articles would be first placed into the storage basket 30 after which the latter would then be inserted into the storage chamber 24 and the roll-top shutter door 25 closed (and locked if desired).

The personal computer desk 10 also includes a desk top 40 having a front end portion 41, a relatively narrower rear end portion 42 and an uppermost or top surface 43. The relatively larger desk top front end portion 41 has formed therein an upwardly opening generally rectangular recess 45 of a polygonal or rectangular configuration sized in width length and depth so as to accommodate an appreciable number of conventional personal computers PC having the usual keyboard K. The size of the recess 45 is approximately 16 inches from side-to-side, 8 inches from front-to back, and 1 inch deep.

The desk top 40 further includes a portion formed as a closure or lid 50 connected by pivots or pivot means 51, 52 to the desk top front end portion 41 for movement of the lid 50 between the open position (FIG. 1) and the closed position (FIG. 2) at which an outermost surface 53 of the lid 50 is in the same plane as the uppermost surface 43 of the desk top 40. When thus closed, the surfaces 43, 53 define a relatively smooth and unbroken work surface. However, in the open position of the lid 50 (FIG. 1) a liquid crystal screen 60 of a conventional construction is exposed for displaying images thereon incident to the operation of the keyboard K or the keys thereof of the personal computer PC. The liquid crystal screen 00 is mounted within a recess 61 of the lid 50 defined by a peripheral flange 62 having an outside size, dimension and configuration corresponding to the peripheral size, outline and dimension of the recess 45. The depth of the rib 62 is such as to accommodate the liquid crystal screen 60 therein without the latter contacting the keyboard K while at the same time assuring that the surfaces 43, 53 are flush when the lid 50 is closed. The liquid crystal screen 60 is, of course, connected to the keyboard through appropriate wiring (not shown) in a conventional manner.

Thus, when the lid 50 is in the position shown in FIG. 1, the personal computer desk 10 can be utilized for a specific specialized purpose, yet by simply closing the lid 50 (FIG. 2), universal aspects of the desk 10 are readily apparent.

Figure 3:
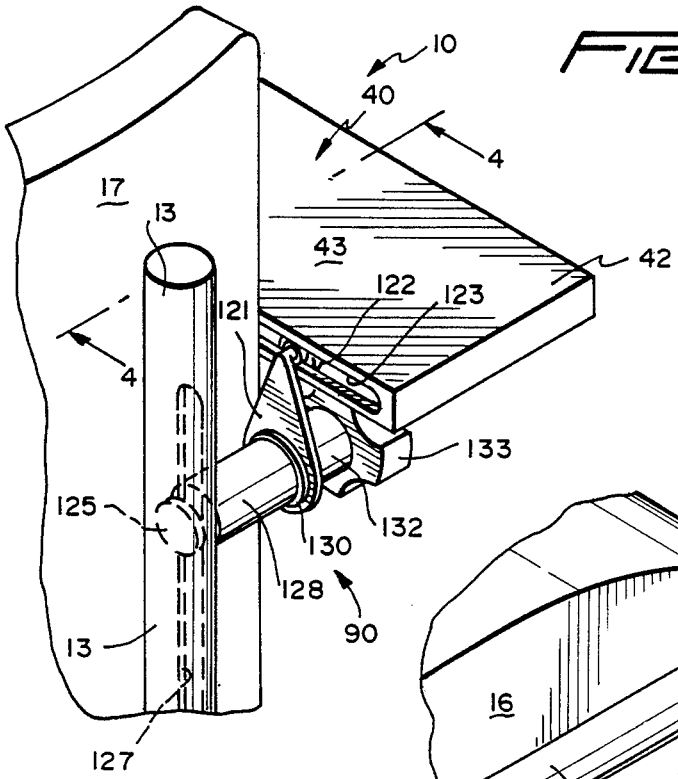
FIG. 3 is a fragmentary enlarged perspective view of the rear desk top adjusting mechanism, and illustrates a pair of brackets adjustably connected to each other and each bracket being reciprocally slidably mounted in an associated slot of the desk frame and desk top.
Figure 5:
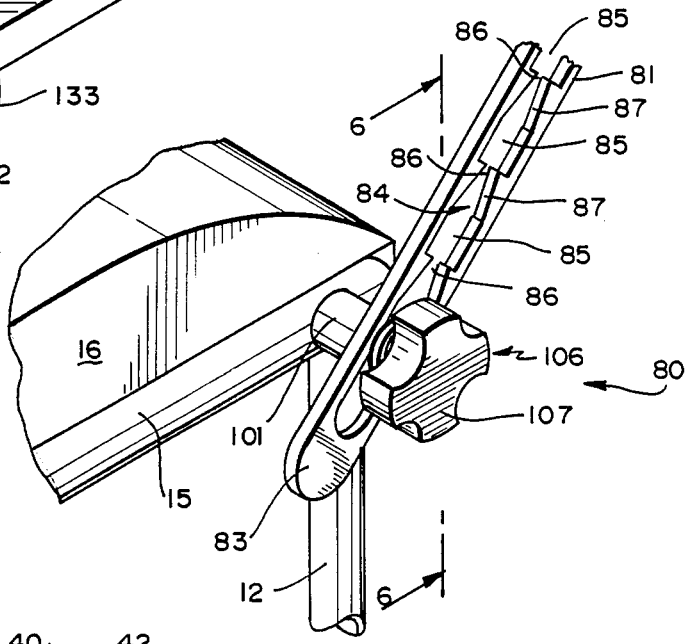
FIG. 5 is an enlarged fragmentary perspective view of the front desk top adjusting mechanism, and illustrates the lower end of the bracket provided with an elongated slot through which passes a pair of members connected to the desk frame for selectively maintaining the desk top front end portion in any one of several positions of relative inclination.
Figure 4:
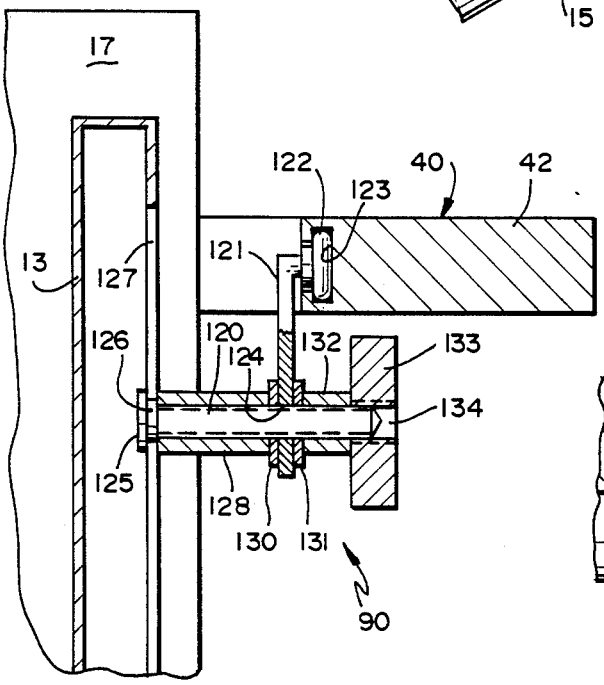
FIG. 4 is an enlarged cross-sectional view taken generally along line 4—4 of FIG. 3, and illustrates details of the rear desk top adjusting mechanism.

The personal computer desk 10 also includes front desk top adjusting means 80 (FIGS. 2, 5 and 6) and the rear desk top adjusting means 90 (FIGS. 2, 3 and 4). The desk top adjusting means 80, 90 are designed to provide universal adjustment of the desk top 40 by not only effecting variations in the elevation thereof, but the inclination of the desk top 40 and its fore and aft position can also be accurately adjusted.

The front desk top adjusting means or mechanism 80 includes a bracket or brace 81 having a first bracket end 82 pivotally connected in a conventional manner to the underside of the desk top 40. A second end or end portion 83 of the bracket 80 includes an elongated slot 84 (FIG. 5) formed of a plurality of successive wide slot portions 85 and narrow slot portions 86 with tapering slot portions 87 intervening therebetween.

Figure 6:
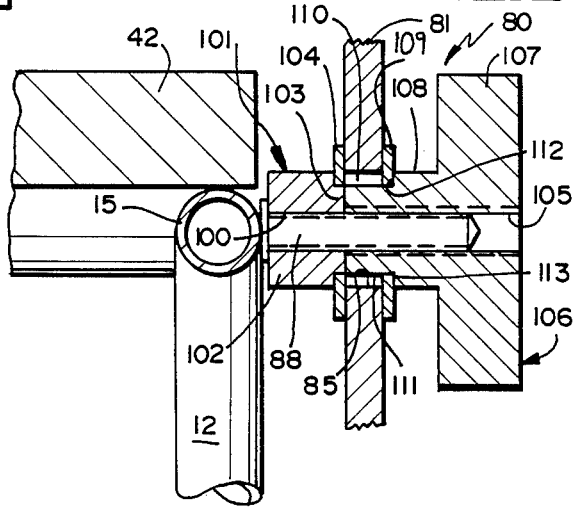
FIG. 6 is an enlarged cross-sectional view taken generally along line 6—6 of FIG. 5, and illustrates details of the front desk adjusting mechanism of FIG. 5.

As is best illustrated in FIG. 6, a first member or externally threaded stud 88 is welded at the intersection (unnumbered) of the tubular members 12, 15 and projects generally normal thereto. The externally threaded stud 88 passes freely through a bore 100 of a plastic bushing 101 having a relatively large cylindrical portion 102 and a smaller cylindrical portion 103. A conical washer 104 is telescopically fit upon the smaller cylindrical portion 103 and its right-hand side surface, as viewed in FIG. 6, is the concave surface thereof which abuts the bracket end or end portion 83. The threaded stud 88 is threadably secured to a threaded bore 105 of a second member 106 in the form of a plastic handle having a knob 107 and a reduced cylindrical portion 108 having two diametrically opposite keyways 111 formed therein. The cylindrical portion 108 slidably, telescopically receives another conical washer 109 whose concave face is to the left, as viewed in FIG. 6, and contacts the end portion 83 of the bracket 80. The conical washer 109 has its internal circular outline (not shown) interrupted by two diametrically opposite opposing keys 112, 113 sized identically to fit in the identically sized keyways 110, 111, respectively. The external diameter of the threaded stud 88 is such as to freely pass through the narrow slot portions 86 while the cylindrical portion 108 will not pass through the narrow slot portions 86 but will be accommodated in the wide slot portions 85. Accordingly, in the position shown in FIGS. 5 and 6, the cylindrical portion 108 of the second member 106 is shown seated within a lowermost of the wide slot portions 85 and is locked thereat by the clamping forces exerted against the bracket end portion 83 by the washers 104, 109 when the latter are "flattened" under the clockwise tightening rotation of the knob 107. However, if it is desired to elevate, lower or tilt the desk top front end portion 41, the knob 107 is merely rotated counterclockwise, as viewed in FIG. 5, which will begin unthreading the threaded bore 105 from the threaded stud 108 thereby decreasing the clamping force exerted between the washers 104, 109, and drawing the cylindrical portion 108 out of the wide slot portion 85. During this counterclockwise rotation of the knob 107, the conical washer 109 is similarly rotated counterclockwise because of the engagement of the keys 112, 113 thereof with the respective keyways 110, 111. When the knob 107 has been unthreaded a sufficient distance to the right relative to the stud 88, again as viewed in FIG. 6, the cylindrical portion 108 will be totally drawn outwardly of the wide slot portion 85 though the threaded stud 88 will still be connected to the threaded bore 105. In this position the position of the bracket 83 can be adjusted up or down because the stud 88 is now free to pass through the narrower slot portions 86. Once another wide slot portion 85 has been selected to achieve the orientation of the desk top 40 desired, the knob 107 is merely rotated clockwise causing rotation of the conical washer 109 and the eventual clamping action of the bracket end portion 83 in conjunction with the conical washer 104, again as illustrated in FIG. 6. Thus, by merely rotating the knob 107 the desk top front end portion 41 can be moved up or down, recalling that the end 82 is pivoted to the underside of the desk top front end portion 41, and also permitting front and back or fore and aft motion in conjunction with the adjustment of the rear desk top adjusting mechanism or means 90, as will be described immediately hereinafter.

Referring specifically to FIGS. 3 and 4 of the drawings, the rear desk top adjusting mechanism 90 includes a first arm 120 and a second arm 121 with the latter having an upper end (unnumbered) carrying a roller 122 which is confined for rolling reciprocal motion in a slot or groove 123 of the desk top rear end portion 42. A lower end (unnumbered) of the second arm 121 includes a circular opening 124 which freely receives the first arm 120 in the form of a threaded stud having a head 125 and a reduced cylindrical shoulder 126 sized to fit in a generally upright or vertical groove 127 of the tubular member 13 The threaded stud 120 passes through a cylindrical bushing 128, conical washers 130, 131 sandwiching therebetween the arm 121, another sleeve or bushing 132 and a handle 133 having a threaded bore 124. The surfaces (unnumbered) of the arm 121 opposing the surfaces (unnumbered) of the washers 130, are preferably provided with radial ribs and grooves over 360° in a conventional fashion to assure excellent gripping therebetween. Obviously, the concave surfaces of the washers 130, 131 are the surfaces directly opposing the arm 121. The handle or knob 133 is shown in its tightened position in which the conical washers 130, 131 have been "flattened" somewhat which not only grips the arm to prevent its pivoting relative to the stud 120, but also clamps adjacent edges of the slot 127 between the head 120 and the sleeve 128. Thus, in this clamped position the desk top rear end portion 42 is immobilized. However, if the knob 133 is turned clockwise, as viewed in FIG. 3, the knob 133 will be loosened (moved to the right in FIG. 4) releasing the clamping force of the washers 130, 131 and the clamping force between the head 125 and sleeve 128. Obviously, the desk top rear end portion 42 can now be moved up and down by sliding the shoulder 126 along the slot 127. Furthermore, if the knob 107 is merely loosened (the cylindrical portion 108 not totally withdrawn from the wide slot portion 85), the desk top 40 can be shifted fore and aft because (1) the roller 122 is free to now move in the slot 123 and (2) while the bracket 81 can not move up and down, it can rotate about the axis of the stud 88, the bore 105 and the knob 107 even if the cylindrical portion 108 is not withdrawn totally from the wide slot portion 85.

Accordingly, from the foregoing description of the front desk top adjusting mechanism 80 and the rear desk top adjusting mechanism 90, it is apparent that the universal nature of the personal computer desk 10 is further enhanced by the universal adjustability of the desk top 40 thereof through forward and aft sliding movement, desk top rear end portion and desk top front end portion 42, 41, respectively, vertical adjustment, both up and down, and front end inclination.

Although a preferred embodiment of the invention has been specifically illustrated and described herein, it is to be understood that minor variations may be made in the apparatus without departing from the spirit and scope of the invention, as defined in the appended claims.

I claim:

1. A personal computer desk comprising a frame including a plurality of legs, a seat and a back rest; a desk top; means for adjusting the position of said desk top relative to said seat and back rest; means for defining an upwardly opening recess in said desk top which is adapted to house substantially entirely therein a personal computer; a lid corresponding generally in peripheral size and contour to the peripheral size and contour of said recess; means mounting said lid for movement between an upright generally open position and a closed position in which said lid generally mates with said recess and encloses a personal computer housed therein, and said lid carrying a liquid crystal screen which is adapted to be connected to a personal computer for displaying images thereon.

2. The personal computer desk as defined in claim 1 wherein said lid mounting means is pivot means for pivotally mounting said lid for pivoting movement between said open and closed positions.

3. The personal computer desk as defined in claim 1 wherein said desk top has an uppermost surface, said lid has an outermost surface on a side of said lid opposite said liquid crystal screen, and said uppermost and outermost surfaces are disposed in a common plane in said lid closed position.

4. The personal computer desk as defined in claim 1 wherein said desk top adjusting means includes means for elevating and lowering a rear end portion of said desk top.

5. The personal computer desk as defined in claim 1 wherein said desk top adjusting means includes means for elevating and lowering a front end portion of said desk top.

6. The personal computer desk as defined in claim 1 wherein said desk top adjusting means includes means for elevating and lowering front and rear end portions of said desk top.

7. The personal computer desk as defined in claim 1 wherein said desk top adjusting means includes means for elevating and lowering front and rear end portions of said desk top, and reciprocally sliding said desk top in forward and rearward directions relative to said back rest.

8. The personal computer desk as defined in claim 1 wherein said desk top adjusting means includes means for elevating, lowering and reciprocally sliding said desk top in forward and rearward directions relative to said back rest.

9. The personal computer desk as defined in claim 1 wherein said desk top adjusting means includes means for elevating and lowering a rear end portion of said desk top, said adjusting means further includes means for elevating and lowering a front end portion of said desk top, and said adjusting means additionally includes means for reciprocally slidingly connecting said desk top rear end portion to said frame in forward and rearward directions relative to said back rest.

10. The personal computer desk as defined in claim 1 including a storage compartment below said seat and in part defined thereby; said storage compartment further being defined by a front wall, a rear wall, a bottom wall and a pair of spaced opposite side walls, one of said side walls is defined by a plurality of articulately connected slats, and opposite lateral track means for guiding the sliding movement of said one side wall between a generally horizontally disposed position beneath said seat at which said storage compartment is accessible and a generally vertically disposed position at which said storage compartment is inaccessible.

11. The personal computer desk as defined in claim 1 including an upwardly opening basket, and means for snap-securing and removing said basket from said frame at a rear side thereof.

12. The personal computer desk as defined in claim 1 wherein said desk top includes generally opposite front and rear end portions, said recess and liquid crystal screen are disposed at said front end portion, front and rear desk top adjusting means at said respective front and rear end portions for adjusting the elevation, inclination and fore-aft position of said desk top, said front adjusting means including a first bracket having first and second ends, said first bracket first end being connected to said desk top, means for selectively adjustably securing said first bracket second end to said frame, said rear adjusting means including a second bracket having first and second ends, said second bracket first end being connected for sliding movement relative to said rear end portion, said second bracket second end being connected for sliding movement relative to said frame in a generally vertical direction, and means for selectively locking said second bracket second end to said frame.

13. The personal computer desk as defined in claim 1 wherein said desk top includes generally opposite front and rear end portions, said recess and liquid crystal screen are disposed at said front end portion, front and rear desk top adjusting means at said respective front and rear end portions for adjusting the elevation, inclination and fore-aft position of said desk top, said front adjusting means including a first bracket having first and second ends, said first bracket first end being connected to said desk top, means for selectively adjustably securing said first bracket second end to said frame, said rear adjusting means including a second bracket having first and second ends, said second bracket first end being connected for sliding movement relative to said rear end portion, said second bracket second end being connected for sliding movement relative to said frame in a generally vertical direction, means for selectively locking said second bracket second end to said frame, and said second bracket first end sliding connection being defined by a roller carried by said second bracket first end received in a groove of said desk top.

14. The personal computer desk as defined in claim 1 wherein said desk top includes generally opposite front and rear end portions, said recess and liquid crystal screen are disposed at said front end portion, front and rear desk top adjusting means at said respective front and rear end portions for adjusting the elevation, inclination and fore-aft position of said desk top, said front adjusting means including a first bracket having first and second ends, said first bracket first end being connected to said desk top, means for selectively adjustably securing said first bracket second end to said frame, said rear adjusting means including a second bracket having first and second ends, said second bracket first end being connected for sliding movement relative to said rear end portion, said second bracket second end being connected for sliding movement relative to said frame in a generally vertical direction, means for selectively locking said second bracket second end to said frame, said second bracket first end sliding connection being defined by a roller carried by said second bracket first end received in a groove of said desk top, and means for pivotally connecting said second bracket second end to said last-mentioned selective locking means.

15. The personal computer as defined in claim 4 wherein said desk top rear end portion elevating and lowering means includes a generally upright slot in said frame, a first arm mounted for sliding movement in said slot, means for selectively adjusting the position of said first arm relative to said slot, and a second arm connected between said first arm and said desk top rear end portion.

16. The personal computer as defined in claim 4 wherein said desk top rear end portion elevating and lowering means includes a generally upright slot in said frame, a first arm mounted for sliding movement in said slot, means for selectively adjusting the position of said first arm relative to said slot, a second arm connected between said first arm and said desk top rear end portion, and said second arm being pivotally connected to said first arm.

17. The personal computer as defined in claim 4 wherein said desk top rear end portion elevating and lowering means includes a generally upright slot in said frame, a first arm mounted for sliding movement in said slot, means for selectively adjusting the position of said first arm relative to said slot, a second arm connected between said first arm and said desk top rear end portion, means for reciprocally sliding said desk top in forward and rearward directions relative to said back rest, and said reciprocal sliding means being defined by a reciprocal sliding connection between said second arm and said desk top rear end portion.

18. The personal computer as defined in claim 4 wherein said desk top rear end portion elevating and lowering means includes a generally upright slot in said frame, a first arm mounted for sliding movement in said slot, means for selectively adjusting the position of said first arm relative to said slot, a second arm connected between said first arm and said desk top rear end portion, means for reciprocally sliding said desk top in forward and rearward directions relative to said back rest, said reciprocal sliding means being defined by a reciprocal sliding connection between said second arm and said desk top rear end portion, and said reciprocal sliding connection includes an elongated slot in said desk top rear end portion which slidingly confines a portion of said second arm.

19. The personal computer as defined in claim 5 wherein said desk top front end portion elevating and lowering means includes a bracket having first and second ends, said bracket first end portion being connected to said desk top front end portion, means for selectively adjustably securing said bracket second end to said frame, said adjustable securing means including an elongated slot in said bracket, said elongated slot having successive wide and narrow slot portions, a first member carried by said frame and being received in said elongated slot, said first member being sized to move through said narrow slot portions, a second member having a portion sized to fit in said wide slot portions but not in said narrow slot portions, and means for connecting said first and second members together when said second member portion is positioned in a selected one of said wide slot portions thereby selectively adjusting said desk top front end portion.

20. The personal computer as defined in claim 5 wherein said desk top front end portion elevating and lowering means includes a bracket having first and second ends, said bracket first end portion being connected to said desk top front end portion, means for selectively adjustably securing said bracket second end to said frame, said adjustable securing means including an elongated slot in said bracket, said elongated slot having successive wide and narrow slot portions, a first member carried by said frame and being received in said elongated slot, said first member being sized to move through said narrow slot portions, a second member having a portion sized to fit in said wide slot portions but not in said narrow slot portions, means for connecting said first and second members together when said second member portion is positioned in a selected one of said wide slot portions thereby selectively adjusting said desk top front end portion, said first member is a threaded stud, and said second member is a handle having a threaded bore engaged by said threaded stud.

21. The personal computer desk as defined in claim 12 wherein said desk top has an uppermost surface, said lid has an outermost surface on a side of said lid opposite said liquid crystal screen, and said uppermost and outermost surfaces are disposed in a common plane in said lid closed position.

22. The personal computer desk as defined in claim 12 including a storage compartment below said seat and in part defined thereby; said storage compartment further being defined by a front wall, a rear wall, a bottom wall and a pair of spaced opposite side walls, one of said side walls is defined by a plurality or articulately connected slats, and opposite lateral track means for guiding the sliding movement of said one side wall between a generally horizontally disposed position beneath said seat at which said storage compartment is accessible and a generally vertically disposed position at which said storage compartment is inaccessible.

23. The personal computer desk as defined in claim 12 including an upwardly opening basket, and means for snap-securing and removing said basket from said frame at a rear side thereof.

24. The personal computer desk as defined in claim 13 wherein said desk top has an uppermost surface, said lid has an outermost surface on a side of said lid opposite said liquid crystal screen, and said uppermost and outermost surfaces are disposed in a common plane in said lid closed position.

25. The personal computer desk as defined in claim 13 including a storage compartment below said seat and in part defined thereby; said storage compartment further being defined by a front wall, a rear wall, a bottom wall and a pair of spaced opposite side walls, one of said side walls is defined by a plurality or articulately connected slats, and opposite lateral track means for guiding the sliding movement of said one side wall between a generally horizontally disposed position beneath said seat at which said storage compartment is accessible and a generally vertically disposed position at which said storage compartment is inaccessible.

26. The personal computer desk as defined in claim 13 including an upwardly opening basket, and means for snap-securing and removing said basket from said frame at a rear side thereof.

27. The personal computer as defined in claim 15 wherein said desk top front end portion elevating and lowering means includes a bracket having first and second ends, said bracket first end portion being connected to said desk top front end portion, means for selectively adjustably securing said bracket second end to said frame, said adjustable securing means including an elongated slot in said bracket, said elongated slot having successive wide and narrow slot portions, a first member carried by said frame and being received in said elongated slot, said first member being sized to move through said narrow slot portions, a second member having a portion sized to fit in said wide slot portions but not in said narrow slot portions, and means for connecting said first and second members together when said second member portion is positioned in a selected one of said wide slot portions thereby selectively adjusting said desk top front end portion.

28. The personal computer desk as defined in claim 15 wherein said desk top has an uppermost surface, said lid has an outermost surface on a side of said lid opposite said liquid crystal screen, and said uppermost and outermost surfaces are disposed in a common plane in said lid closed position.

29. The personal computer desk as defined in claim 19 wherein said desk top has an uppermost surface, said lid has an outermost surface on a side of said lid opposite said liquid crystal screen, and said uppermost and outermost surfaces are disposed in a common plane in said lid closed position.

30. The personal computer desk as defined in claim 27 wherein said desk top has an uppermost surface, said lid has an outermost surface on a side of said lid opposite said liquid crystal screen, and said uppermost and outermost surfaces are disposed in a common plane in said lid closed position.

* * * * *